US010317022B2

(12) United States Patent
Tannahill et al.

(10) Patent No.: US 10,317,022 B2
(45) Date of Patent: Jun. 11, 2019

(54) SPIRAL WRAP LIGHTING SYSTEM

(71) Applicant: Angler's-Friend, LLC, Merriam, KS (US)

(72) Inventors: Corben D. Tannahill, Merriam, KS (US); David B. Tannahill, Merriam, KS (US)

(73) Assignee: Angler's-Friend, LLC, Merriam, KS (US)

( * ) Notice: Subject to any disclaimer, the term of this patent is extended or adjusted under 35 U.S.C. 154(b) by 0 days.

(21) Appl. No.: 14/859,269

(22) Filed: Sep. 19, 2015

(65) Prior Publication Data

US 2017/0082251 A1 Mar. 23, 2017

Related U.S. Application Data

(60) Provisional application No. 62/054,718, filed on Sep. 24, 2014, provisional application No. 62/062,252, filed on Oct. 10, 2014.

(51) Int. Cl.

| | |
|---|---|
| ***F21S 4/22*** | (2016.01) |
| ***F21V 21/32*** | (2006.01) |
| *F21Y 115/10* | (2016.01) |

(52) U.S. Cl.

CPC ..... *F21S 4/22* (2016.01); *F21V 21/32* (2013.01); *F21Y 2115/10* (2016.08)

(58) Field of Classification Search

CPC ..... F21S 4/22; F21Y 2115/10; F21V 21/32

See application file for complete search history.

(56) References Cited

U.S. PATENT DOCUMENTS

| | | | | |
|---|---|---|---|---|
| 6,371,637 | B1 * | 4/2002 | Atchinson | F21V 19/005 362/249.04 |
| 6,580,228 | B1 * | 6/2003 | Chen | F21K 9/90 257/E25.02 |
| 2002/0071276 | A1 * | 6/2002 | Blum | F21V 19/00 362/249.07 |
| 2004/0037079 | A1 * | 2/2004 | Luk | H05B 33/0857 362/249.06 |
| 2005/0162850 | A1 * | 7/2005 | Luk | H05B 33/0857 362/227 |
| 2006/0158878 | A1 * | 7/2006 | Howell | F21S 4/22 362/223 |
| 2011/0267812 | A1 * | 11/2011 | Van De Ven | F21K 9/00 362/235 |
| 2013/0107514 | A1 * | 5/2013 | McNabb | F21V 21/00 362/231 |
| 2014/0111982 | A1 * | 4/2014 | Kuenzler | F21V 19/005 362/217.05 |

(Continued)

*Primary Examiner* — Elmito Breval

(74) *Attorney, Agent, or Firm* — Husch Blackwell LLP

(57) ABSTRACT

The present invention, a spiral wrap lighting system, may include a series of light-emitting diodes, commonly referred to within the lighting industry as an LED flexible strip, affixed upon or otherwise attached to a surface or surfaces of a spiraling tubular shape, such as would occur if a tube were to have a torsion cut, which may include materials known to the electrical industry as spiral wrap sleeve tubing, being configured overall into any combination of innumerable linear or curvilinear shapes being capable of spanning within, from, between, or wrapping around other objects for the purpose of providing illumination.

13 Claims, 1 Drawing Sheet

(56) References Cited

U.S. PATENT DOCUMENTS

| | | | | |
|---|---|---|---|---|
| 2014/0268740 | A1* | 9/2014 | Veres | H01L 33/54<br>362/235 |
| 2014/0331532 | A1* | 11/2014 | Deppiesse | F21S 4/005<br>40/541 |

* cited by examiner

SPIRAL WRAP LIGHTING SYSTEM

CROSS-REFERENCE TO RELATED APPLICATIONS

This Application claims priority to U.S. Provisional Patent Application Ser. No. 62/054,718, filed on Sep. 24, 2014, to Corben D. Tannahill and David B. Tannahill, entitled "Spiral Wrap LED Lighting System," the entire disclosure of which is incorporated herein by reference, and U.S. Provisional Patent Application Ser. No. 62/062,252, filed on Oct. 20, 2014, to Corben D. Tannahill and David B. Tannahill, entitled "Spiral Wrap LED Lighting System," the entire disclosure of which is incorporated herein by reference.

BACKGROUND

The present invention relates to electric lighting, in particular, light-emitting diode (LED) lighting which has emerged as an increasingly common lighting alternative. There are many compelling reasons to utilize LED lighting solutions such as size, light output or lumens, color spectrum of light, low energy consumption, low heat output, ability to be variably dimmed, and very long life. Manufacturers of traditional lighting have relied upon the standard of the screw in base for a typical incandescent light bulb. Some LED lighting solutions are encapsulated into a traditional screw-in type light bulb base; however, many benefits of LED lighting such as its small size are lost through the constraints of traditional lighting hardware. Other shapes for LED lighting have also emerged including rigid shapes such as tubular shapes for replacement lamps for fluorescent fixtures and flexible shapes such as flexible strips and rope like accent lighting.

An unresolved need remains for a flexible LED lighting solution that also has a sufficient structural element so as to maintain a desired shape and general configuration. The incandescent and fluorescent lamp replacement versions of LED lighting are too rigid and require traditional lamp and lighting materials to be utilized, and the rope-like LED accent lighting lacks any structural capacity so as to maintain any particular shape on its own accord. A material to provide a structure is needed for LED lighting that is both flexible and adaptable being configurable in many different ways while also allowing for easy replacement when the LED life cycle has been expended.

BRIEF SUMMARY OF THE INVENTION

One embodiment of the present invention directed to a spiral wrap LED lighting system may include a series of LEDs, commonly referred to within the lighting industry as an LED flexible strip, affixed upon or otherwise attached to a surface of a spiraling tubular-shaped sleeve being capable of spanning from or between or wrapping around other objects.

The sleeve may be formed from a coiled strip of material having sufficient structure for being adapted to and maintained in a desired shape. The sleeve may be constructed of a spiral cut tube. Accordingly, the sleeve can include a length of tubing having a spiral cut made therethrough extending from a first end to a second end of the tubing and rotating around its circumference. The sleeve includes at least one opening defined between two revolutions of the coiled strip of material through which cabling or wires may enter or exit an interior of the sleeve.

A plurality of axially and spirally spaced lighting sources may be attached to the sleeve. The lighting sources may be LEDs. In one embodiment, the lighting sources are affixed to a flexible strip and the flexible strip is attached to the sleeve. The flexible strip may lack structure sufficient for being adapted to and maintained in a desired shape.

BRIEF DESCRIPTION OF THE DRAWINGS

In the accompanying drawing, which forms a part of the specification and is to be read in conjunction therewith in which like reference numerals are used to indicate like or similar parts in the various views.

DETAILED DESCRIPTION OF THE INVENTION

Figure 1:
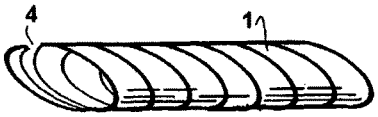
FIG. 1 is a side perspective view of a spiral wrap sleeve tubing in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

Figure 6:
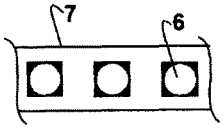
FIG. 6 is a top plan view of an LED strip including multiple LEDs.

One embodiment of the present invention is directed to a spiral wrap LED lighting system 8 (FIG. 8, FIG. 9, FIG. 10, FIG. 11) that includes a series of light-emitting diodes or LEDs 6 (FIG. 4, FIG. 5, FIG. 6, FIG. 9), commonly referred to within the lighting industry as an LED flexible strip 7 (FIG. 6), affixed upon, or otherwise attached to, a surface or surfaces of a spiraling tubular shape 8 (FIG. 8-11), such as would occur if a tube were to have a torsion cut, being configured into an overall shape of any combination of linear or curvilinear shapes being capable of spanning within, from, between, or wrapping around other objects.

Figure 8:
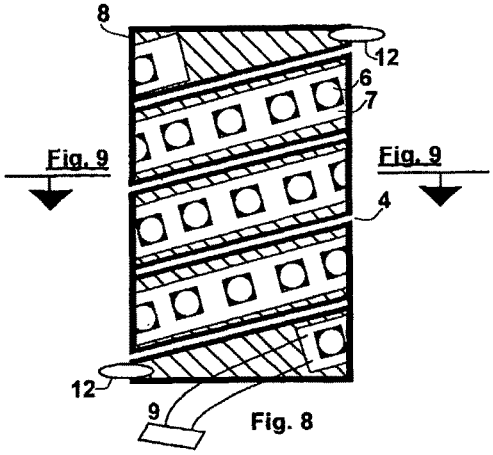
FIG. 8 is a side view of a spiral wrap sleeve tubing having a flexible LED strip attached to an exterior surface thereof so as to form a spiral wrap LED lighting system in accordance with one embodiment of the present invention.

The spiral wrap LED lighting system 8 (FIG. 8, FIG. 9, FIG. 10, FIG. 11) of the present invention can eliminate the need for some traditional lighting hardware such as a lamp socket and traditional bulb, while providing multi-directional lighting (FIG. 9), flexible physical shape and sufficient structure to maintain a desired shape (FIG. 8). The desired shape may be the shape that is achieved when the system 8 is applied to or wrapped around an object such as a lamp rod 11, a lighting fixture or bracket, architectural components, automotive parts, sporting goods, crappie lights, furniture, trees, and a host of other objects. It will be appreciated that the foregoing objects are simply provided as non-limiting examples, and that the system 8 may be applied to a large number of other objects.

The spiral wrap lighting system 8 may include structural elements or components that permits the system 8 to be flexible and maintain a desired shape. For example, in addition to or in alternative to materials such as plastics, rubbers, textiles, cellulosic materials, and polymers, the spiral wrap sleeve tubing 1 may comprise elements such as wires, stiffening members, metallic strips, or other materials having structural properties allowing them to be flexible and maintain a desired shape. It will be appreciated that the strip 7 may optionally include materials, such as structural elements or components that permit the strip 7 to provide structural support to be flexible and maintain a desired shape. It will further be appreciated that the spiral wrap sleeve tubing 1 and strip 7 may be integrally formed during a manufacturing process. In one embodiment, the sleeve tubing 1 and strip 7 may be co-extruded, extruded together in a single die, homogeneously formed and/or otherwise combined. Such an embodiment may also include elements such as wires, stiffening members, metallic strips, or other materials having structural properties allowing them to be flexible and maintain a desired shape. These elements may be located, for example, within the inner core of the sleeve tubing 1 (i.e., integrated at least partially or wholly within the material forming the sleeve tubing 1) or may be located within the interior 3 and/or the exterior 2 of the sleeve tubing 1.

Figure 3:
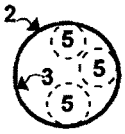
FIG. 3 is a schematic end view of a spiral wrap sleeve tubing showing cabling or wiring disposed within an interior space of the spiral wrap sleeve tubing in accordance with one embodiment of the present invention.
Figure 4:
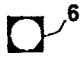
FIG. 4 is a top plan view of a singular LED.
Figure 5:
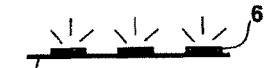
FIG. 5 is a side view of an LED strip including multiple LEDs.
Figure 2:
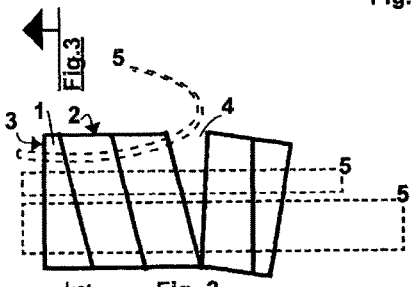
FIG. 2 is a side view of a spiral wrap sleeve tubing illustrating cables or wires disposed within an interior and further illustrating cables or wires entering or exiting a separation or opening defined between two spirals in accordance with one embodiment of the present invention.
Figure 7:
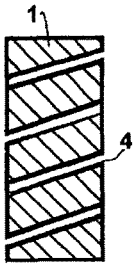
FIG. 7 is a side view of a spiral wrap sleeve tubing in accordance with one embodiment of the present invention.
Figure 9:
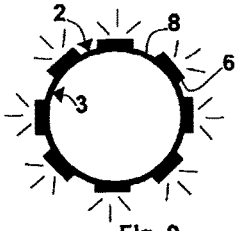
FIG. 9 is an end view of a spiral wrap LED lighting system in accordance with one embodiment of the present invention.
Figure 10:
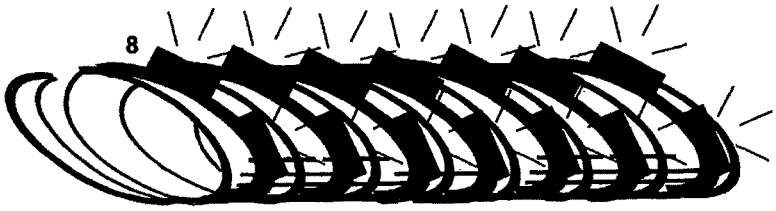
FIG. 10 is a side perspective view of a spiral wrap LED lighting system in accordance with one embodiment of the present invention.

Embodiments of the present invention may combine adhesive backed, flexible ribbon or strip 7 (FIG. 5) LED lighting, a common form of LED lighting comprising a series of LEDs 6 (FIG. 4, FIG. 5, FIG. 6, FIG. 9), with a commonly utilized form of electrical conduit, commonly produced from plastics such as polyethylene (PE), acrylonitrile butadiene styrene (ABS), nylon or the like, being used for containing within its interior 2 (FIG. 2, FIG. 3) wires and cabling 5, being known to the electrical industry as spiral wrap sleeve tubing 1 (FIG. 1, FIG. 2, FIG. 3, FIG. 7), which will be referred to herein as, SWST, which permits cabling 5 from within an interior 3 to exit (FIG. 2) at any point along the openings 4 (FIG. 2, FIG. 7) created by the spiral shape so as to move from the interior 3 to the exterior 2 of the SWST (FIG. 2, FIG. 3).

By affixing LED strips 7 (FIG. 5, FIG. 6) to the exterior surface 3 of the SWST (FIG. 8, FIG. 9) these two component parts may be combined into an optimally cost effective and easily produced embodiment of the present invention, a spiral wrap LED lighting system 8 (FIG. 8-11), a novel lighting solution which resolves unmet needs for the lighting industry.

Figure 11:
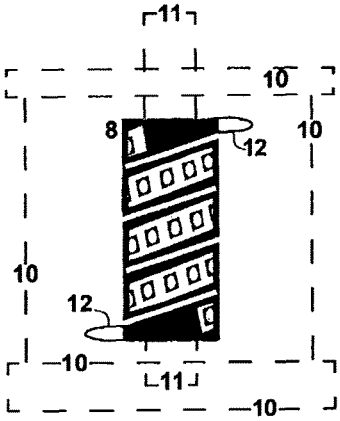
FIG. 11 is a side view of a spiral wrap LED lighting system integrated with a generic lamp fixture in accordance with one embodiment of the present invention.

The spiral wrap LED lighting system 8 of the present invention resolves numerous lighting issues, such as the constraints of traditional lighting hardware. For example, within a light fixture, the area consumed by a lamp socket is not illuminated, causing a dark area within a lighting fixture. The present invention resolves this by spanning, with illumination not just the area for placement of a traditional bulb, but over the entirety of a desired distance. Another issue is simply how to physically place, and then service, a traditional bulb within a lamp. For example, when it's desired for a lamp base to be illuminated, placing a traditional bulb and associated hardware within a lamp base is bulky and difficult both for installation and service. The present invention resolves this through embodiments which are small yet capable of spanning any desired portion of an interior space of a lamp 10 (FIG. 11).

The spiral wrap LED lighting system 8 of the present invention also resolves lighting issues relating to usage of LED lighting strips as an alternative within a lamp base. As previously described, LED rope lights have no capacity to maintain a particular shape nor do they offer enough concentrated light output within a specified shape to meet some lighting demands. Furthermore, both LED ropes and strips alone, lack sufficient physical structure. Some solutions have been to affix LED strips upon square or round tubing, but this requires the tubing to become physically mounted within the lamp assembly, thus necessitating lamp disassembly to change the LED Strips. The present invention resolves these issues, by means of the coiling or spiral shape, by simply wrapping (FIG. 11) around, as relevant, traditional lamp rod 11 materials within a lamp 10.

Simple, generic, mechanical fasteners 12 (FIG. 11), such as hook and loop patches, wire ties, etc. may attach the present invention to virtually any surface. These fasteners 12 may be located at the ends of a length of the spiral wrap LED lighting system 8 (FIG. 11) or utilized along any opening 4. The present invention may also be coiled or otherwise wrapped or placed around another object's shape so as to be configured into a particular shape or pattern similarly to how neon lighting and holiday string lighting can be configured upon or around another object.

The present invention may also utilize standardized, quick connect wiring fasteners and or wiring leads 9 (FIG. 10) commonly available for LED strip lighting to facilitate ease of installation and service.

It is to be understood that the present invention is not limited by the herein described configurations of either SWST or LED strip lighting or the combinations shown thereof nor by the choice of spiral surface—be it the interior or exterior or both of the spiral tubular shape, or of a particular dimension or torsion spiral pitch. Rather, the embodiments described herein are simply illustrative, as there are many possible configurations, materials, and processes which may be derived from the present invention. The present invention may be suitable for use with other types of lighting sources or lumenating elements.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

DRAWING KEY

1—Spiral Wrap Sleeve Tubing
2—Exterior of Spiral Wrap Sleeve Tubing
3—Interior of Spiral Wrap Sleeve Tubing
4—Opening in Spiral Wrap Sleeve Tubing
5—Cable or Wiring within Spiral Wrap Sleeve Tubing
6—Light Emitting Diode (LED)
7—LED Strip or LED Flexible Strip
8—Spiral Wrap Lighting
9—Wiring Leads from LED Strip with Quick Connect Wiring Harness
10—Generic Lamp Parts for Contextual Illustrative Purposes
11—Generic Lamp Rod
12—Generic Mechanical Fastener such as Hook and Loop

What is claimed is:

1. A lighting system comprising:

a flexible tubular sleeve formed from a coiled strip of material, said sleeve having a structure sufficient for being adapted to and maintained in a desired shape; and a plurality of axially and spirally spaced lighting sources affixed to a flexible strip, wherein said flexible strip lacks structure sufficient for being adapted to and maintained in a desired shape;

wherein said flexible strip is affixed to said sleeve;

wherein said lighting system has structure sufficient for being maintained in a desired flexible tubular shape on its own accord.

2. The lighting system of claim 1, wherein said sleeve is constructed of a spiral cut tube.

3. The lighting system of claim 1, wherein said sleeve comprises a length of tubing having a spiral cut defined therethrough from a first end to a second end of the tubing and rotating around its circumference.

4. The lighting system of claim 1, wherein said sleeve includes an opening defined between two adjacent revolutions of said coiled strip of material.

5. The lighting system of claim 4, wherein said opening is created by a spiral cut defined in said sleeve.

6. The lighting system of claim 4, wherein said opening permits cabling or wires to enter or exit an interior of the sleeve.

7. The lighting system of claim 1, wherein said lighting sources are light-emitting diodes.

8. The lighting system of claim 1, wherein said sleeve is a spiraling tubular-shaped sleeve.

9. The lighting system of claim 1, wherein said sleeve is capable of being wrapped around an object.

10. The lighting system of claim 9, wherein said object includes at least one or a lamp rod, a lighting fixture, an architectural component, an automotive part, a sporting good, a fishing light, furniture, and a tree.

11. The lighting system of claim 1, wherein said flexible strip is an adhesive backed strip.

12. The lighting system of claim 1, wherein said sleeve is capable of being coiled around an object.

13. A lighting system comprising:

a flexible tubular sleeve formed from a coiled strip of material, said sleeve having a structure sufficient for being adapted to and maintained in a desired shape;

an opening between an interior and an exterior of said sleeve rotating around its circumference and being defined between two adjacent revolutions of said coiled strip of material, wherein said opening permits wrapping whereby an object may enter or exit an interior of the sleeve; and a plurality of axially and spirally spaced lighting sources affixed to a flexible strip, wherein said flexible strip lacks structure sufficient for being adapted to and maintained in a desired shape;

wherein said flexible strip is affixed to said sleeve;

wherein said lighting system has structure sufficient for being adapted to and maintained in a desired flexible tubular spiral sleeve shape.

* * * * *